US011376861B2

(12) United States Patent
Hirata et al.

(10) Patent No.: US 11,376,861 B2
(45) Date of Patent: Jul. 5, 2022

(54) SUPPLY DEVICE AND LIQUID EJECTING APPARATUS

(71) Applicant: SEIKO EPSON CORPORATION, Tokyo (JP)

(72) Inventors: Koki Hirata, Nagano (JP); Keigo Sugai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/800,668

(22) Filed: Feb. 25, 2020

(65) Prior Publication Data

US 2020/0276826 A1 Sep. 3, 2020

(30) Foreign Application Priority Data

Feb. 28, 2019 (JP) ..... JP2019-036428

(51) Int. Cl.
*B41J 2/175* (2006.01)

(52) U.S. Cl.
CPC ..... *B41J 2/17556* (2013.01)

(58) Field of Classification Search
CPC .... B41J 2/175; B41J 2/17556; B41J 2/17596; Y10T 137/0396
See application file for complete search history.

(56) References Cited

U.S. PATENT DOCUMENTS 4,445,797 A * 5/1984 Barozzi ..... B41J 7/94 400/162.1
2005/0012791 A1 1/2005 Anderson et al.
2006/0028517 A1 2/2006 Ishizawa et al.
2009/0122093 A1 5/2009 Mutoh
2012/0050422 A1* 3/2012 Kondo ..... B41J 2/17509 347/85
2015/0097900 A1 4/2015 Araki et al.
2015/0224786 A1* 8/2015 Otsuka ..... B41J 2/18 347/92
2015/0314606 A1 11/2015 Moriguchi et al.
2016/0144628 A1* 5/2016 Sato ..... B41J 2/175 347/85
2017/0087836 A1* 3/2017 Yokoo ..... B41J 2/1433

FOREIGN PATENT DOCUMENTS

| | | |
|---|---|---|
| CN | 1922020 | 2/2007 |
| CN | 105034604 | 11/2015 |
| JP | 3467685 | 11/2003 |
| JP | 2006-192785 | 7/2006 |
| JP | 2015-092549 | 5/2015 |

* cited by examiner

*Primary Examiner* — Anh T Vo
(74) *Attorney, Agent, or Firm* — Workman Nydegger

(57) ABSTRACT

A supply device that supplies a liquid to a liquid ejecting head, includes one or more tanks that house the liquid; a liquid flow path coupled to the one or more tanks and the liquid ejecting head; and a pressure-adjusting portion that adjusts a pressure in the one or more tanks. The one or more tanks are provided between the pressure-adjusting portion and the liquid flow path. The pressure-adjusting portion includes a communication path that communicates with the one or more tanks, a pressure chamber provided with a diaphragm and coupled to the communication path, and an urging portion that urges the diaphragm in a direction in which the pressure chamber expands.

6 Claims, 7 Drawing Sheets

SUPPLY DEVICE AND LIQUID EJECTING APPARATUS

The present application is based on, and claims priority from JP Application Serial Number 2019-036428, filed Feb. 28, 2019, the disclosure of which is hereby incorporated by reference herein in its entirety.

BACKGROUND

1. Technical Field

The present disclosure relates to a supply device and a liquid ejecting apparatus.

2. Related Art

To date, various devices that supply a liquid to a liquid ejecting head have been used. In such devices, it is necessary to adjust the pressure in the liquid ejecting head to a predetermined pressure. If the pressure in the liquid ejecting head, that is, the pressure (negative pressure) applied in a direction opposite from the direction of the liquid toward the nozzle is excessively low, the liquid may leak from the nozzle, and, if the negative pressure is excessively high, a filling failure may occur when filling the liquid ejecting head with liquid. Accordingly, adjustment of the negative pressure to a predetermined pressure has been performed to date. For example, JP-A-2006-192785 discloses an ink jet printer that adjusts a negative pressure to a predetermined pressure using a pump.

However, the cost of the pump is high and the pump is large. Consequently, if a pump is used as a pressure-adjusting portion to adjust the negative pressure to a predetermined pressure, the cost and size of the apparatus increase. To date, there has been no device that applies a desired negative pressure to the liquid of the liquid ejecting head with a simple configuration. In addition, in recent years, various types of liquids have been used, and the durability of the pressure-adjusting portion may be reduced by the liquid coming into contact with the pressure-adjusting portion.

SUMMARY

According to an embodiment of the present disclosure, a supply device that supplies a liquid to a liquid ejecting head, includes one or more tanks that house the liquid, a liquid flow path coupled to the one or more tanks and the liquid ejecting head, and a pressure-adjusting portion that adjusts a pressure in the one or more tanks. The one or more tanks are provided between the pressure-adjusting portion and the liquid flow path. The pressure-adjusting portion includes a communication path that communicates with the one or more tanks, a pressure chamber provided with a diaphragm and coupled to the communication path, and an urging portion that urges the diaphragm in a direction in which the pressure chamber expands.

DESCRIPTION OF EXEMPLARY EMBODIMENTS

Figure 1:
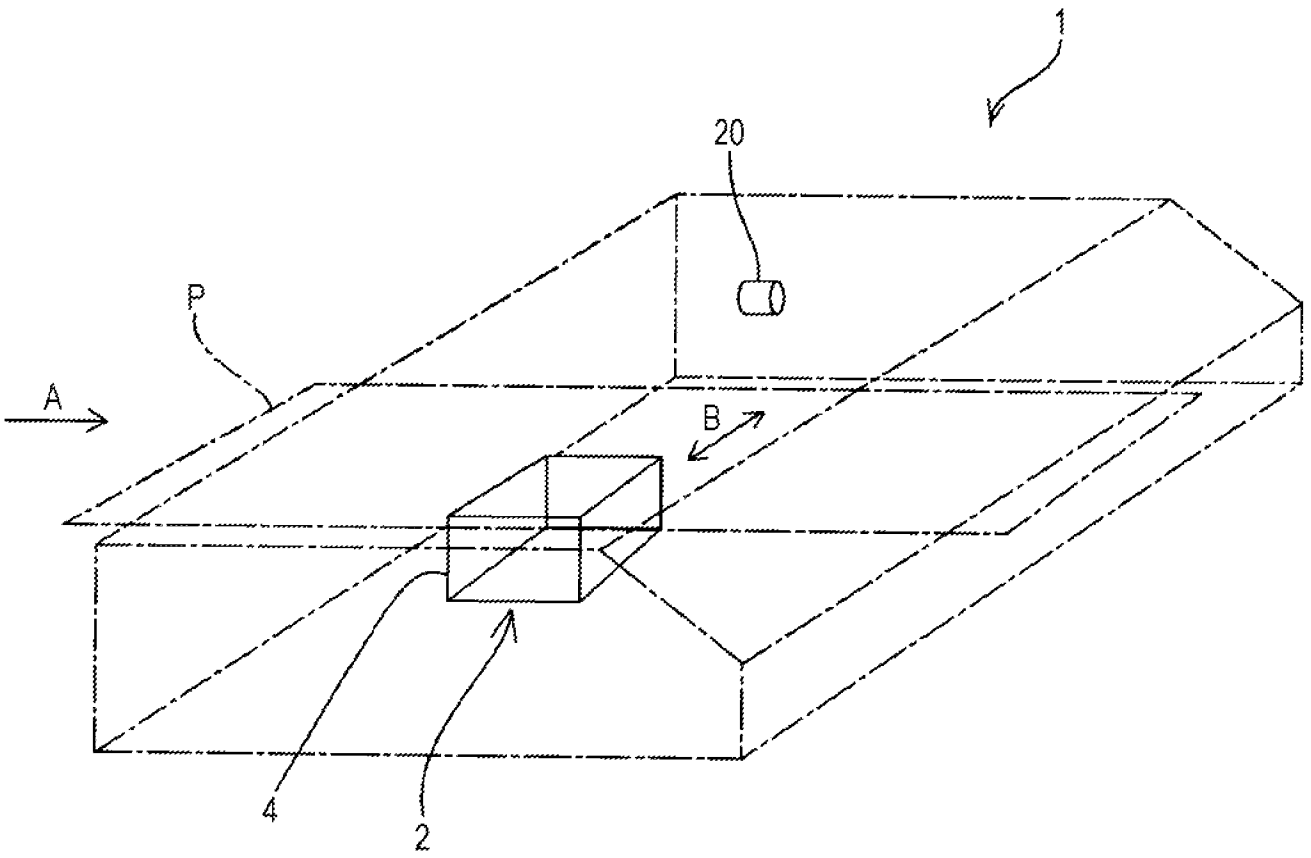
FIG. 1 is a schematic diagram of a liquid ejecting apparatus according to Example 1 of the present disclosure.

At first, the present disclosure will be schematically described.

According to a first embodiment of the disclosure, a supply device that supplies a liquid to a liquid ejecting head, includes one or more tanks that house the liquid; a liquid flow path coupled to the one or more tanks and the liquid ejecting head; and a pressure-adjusting portion that adjusts a pressure in the one or more tanks, in which the one or more tanks are provided between the pressure-adjusting portion and the liquid flow path, and the pressure-adjusting portion includes a communication path that communicates with the one or more tanks, a pressure chamber provided with a diaphragm and coupled to the communication path, and an urging portion that urges the diaphragm in a direction in which the pressure chamber expands.

According to this embodiment, because the pressure-adjusting portion that adjusts the pressure in the one or more tanks uses a simple configuration including a communication path, a pressure chamber, and an urging unit, with a simple configuration, a desired negative pressure can be applied to the liquid in the liquid ejecting head. In addition, because the pressure-adjusting portion is provided in a location different from the liquid flow path coupling the one or more tanks and the liquid ejecting head, contact between the pressure-adjusting portion and the liquid can be suppressed, and deterioration in durability can be suppressed.

A liquid ejecting apparatus according to a second embodiment of the present disclosure includes the supply device according to the first embodiment, in which the liquid ejecting head ejects the liquid onto a medium to form an image.

According to this embodiment, it is possible to form an image on a medium by using the supply device configured to apply a desired negative pressure to the liquid of the liquid ejecting head with a simple configuration and excellent durability.

According to a liquid ejecting apparatus of a third embodiment of the present disclosure, in the second embodiment, the liquid ejecting apparatus further includes a carriage provided with the liquid ejecting head, and a movement mechanism that reciprocates the carriage with respect to the medium, the carriage being provided with the one or more tanks.

According to this embodiment, in the liquid ejecting apparatus having the movement mechanism that reciprocates the carriage, the liquid flow path, which is coupled to the one or more tanks and the liquid ejecting head, can be shortened.

According to a liquid ejecting apparatus of a fourth embodiment of the present disclosure, in the third embodiment, the carriage is provided with a plurality of the tanks.

According to this embodiment, different liquids can be ejected simultaneously by storing different liquids in the plurality of tanks, and by storing the same liquid in the plurality of tanks, the same liquid can be efficiently introduced into the liquid ejecting head, and the liquid can be ejected in a plurality of different ejection amounts according to the image forming mode.

According to a liquid ejecting apparatus of a fifth embodiment of the present disclosure, in the fourth embodiment, the plurality of tanks communicate with the pressure-adjusting portion.

According to this embodiment, the apparatus can be simplified in a configuration including the plurality of tanks.

According to a liquid ejecting apparatus of a sixth embodiment of the present disclosure, in any one of the third to fifth embodiments, the carriage is provided with the pressure-adjusting portion.

According to this embodiment, because the carriage includes not only the one or more tanks but also the pressure-adjusting portion, the apparatus can be particularly simplified, and by reducing the distance between the one or more tanks and the pressure-adjusting portion, the pressure adjustment accuracy in the one or more tanks, and thus the pressure adjustment accuracy in the liquid ejecting head, can be increased.

Embodiments according to the present disclosure will be described below with reference to the accompanying drawings.

Figure 2:
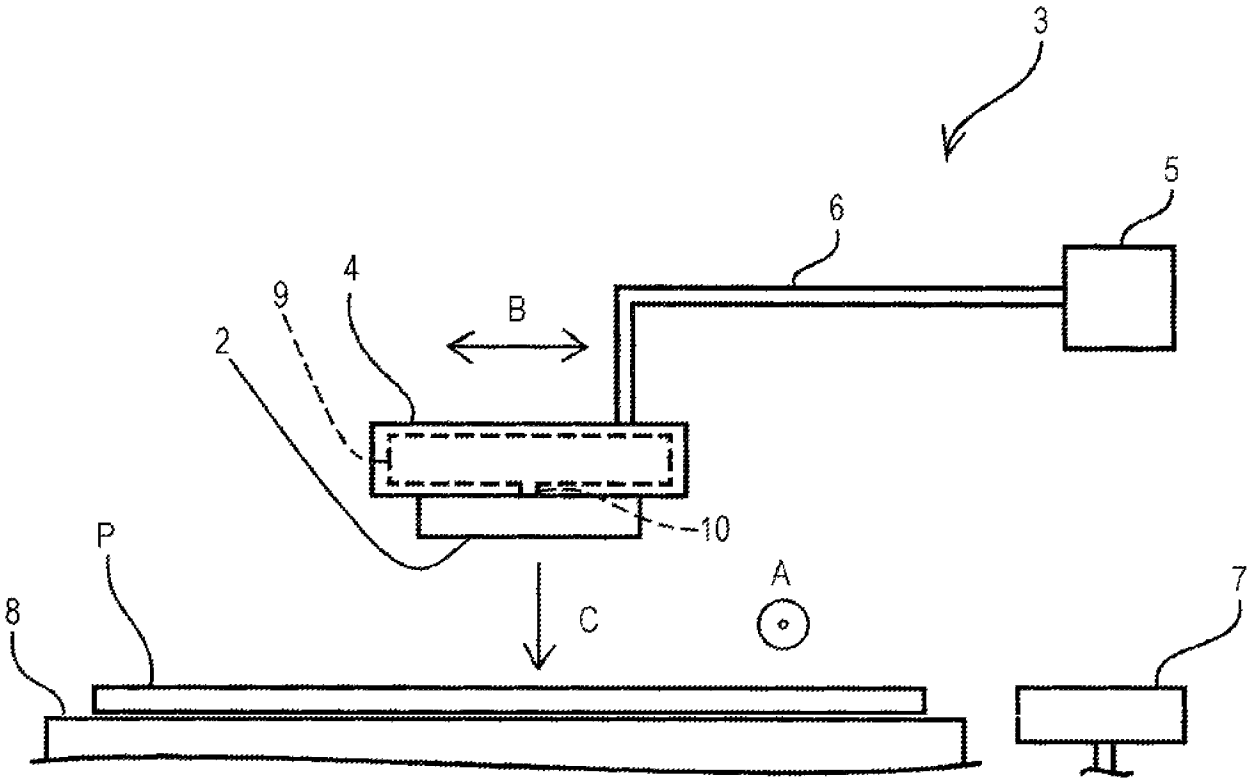
FIG. 2 is a schematic diagram of a supply device of the liquid ejecting apparatus according to Example 1 of the present disclosure.
Figure 3:
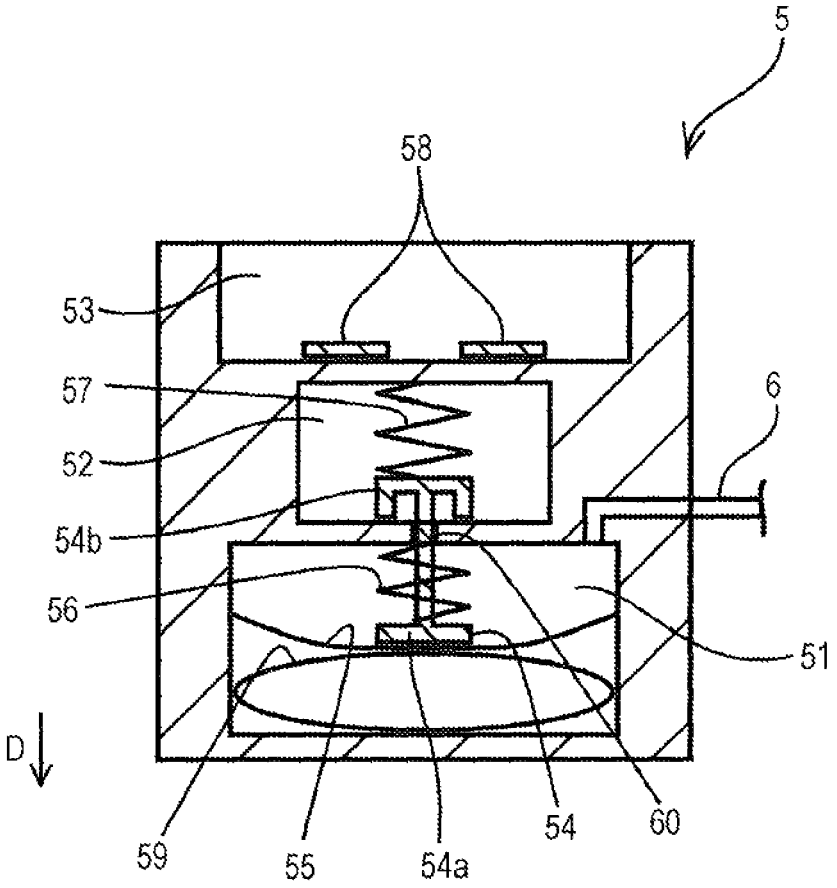
FIG. 3 is a schematic diagram of a pressure-adjusting portion of the liquid ejecting apparatus according to Example 1 of the present disclosure.

Example 1 (FIGS. 1 to 3)

First, an outline of a liquid ejecting apparatus 1 according to Example 1 of the present disclosure will be described with reference to FIG. 1.

The liquid ejecting apparatus 1 according to the present example forms an image by reciprocating a carriage 4 in a width direction B intersecting a transport direction A by a movement mechanism 20 including a motor or the like, the carriage 4 being provided, on a side facing a medium P, with a liquid ejecting head 2 that ejects ink, which is a liquid, onto the medium P transported in a transport direction A by a transport portion (not illustrated). Specifically, the medium P is intermittently driven in the transport direction A, and the liquid ejecting head 2 is reciprocated in the width direction B via the carriage 4 to perform recording by ejecting ink from a plurality of nozzles (not illustrated).

Here, the liquid ejecting apparatus 1 of the present example is a serial printer that performs printing by alternately repeating transportation of the medium P by a predetermined amount and reciprocation of the carriage 4; however, the liquid ejecting apparatus 1 of the present example may be a line printer that uses a line head in which nozzles are formed in a line along the width direction B and that performs continuous printing while transporting the medium P continuously.

In addition, the liquid ejecting apparatus 1 according to the present example is configured to transport the medium P with respect to the liquid ejecting head 2 to form an image. However, the liquid ejecting head 2 may be moved with respect to the medium P that is not moving, or both the medium P and the liquid ejecting head 2 may be moved.

Next, a detailed configuration of a supply device 3 that supplies ink to the liquid ejecting head 2 that is a main portion of the liquid ejecting apparatus 1 of the present example will be described in detail with reference to FIGS. 2 and 3.

As illustrated in FIG. 2, the supply device 3 according to the present example includes the carriage 4 having the liquid ejecting head 2 that ejects ink in an ejection direction C toward the medium P supported by a medium supporter 8. The carriage 4 is provided with a tank 9 that houses ink, and is configured to supply ink from the tank 9 to the liquid ejecting head 2 via a liquid flow path 10. The tank 9 of the present example is configured to be fixed to the carriage 4 and replenished by pouring ink from the outside, but is not limited to such a configuration. For example, a configuration other than the configuration of the present example, such as a cartridge-type configuration that is removable from the carriage 4 or a configuration that is integrally formed with the liquid ejecting head 2, may be used.

In addition, as illustrated in FIG. 2, the supply device 3 of the present example includes a cap 7 coupled to a suction mechanism (not illustrated). By capping and sucking the nozzle-forming surface of the liquid ejecting head 2 with the cap 7, it is possible to perform initial filling of ink into the liquid ejecting head 2, cleaning of the liquid ejecting head 2, and the like.

A self-sealing valve 5, as a pressure-adjusting portion, is coupled to the tank 9 via a communication path 6. The self-sealing valve 5 adjusts the pressure in the liquid ejecting head 2 coupled to the tank 9 via the liquid flow path 10 by adjusting the pressure in the tank 9. Specifically, the self-sealing valve 5 creates a negative pressure in the tank 9 to create a negative pressure in the liquid ejecting head 2, and because the liquid ejecting head 2 has a negative pressure, an ink meniscus is suitably formed in nozzles (not illustrated).

As illustrated in FIG. 3, the self-sealing valve 5 includes the communication path 6 that communicates with the tank 9, a pressure chamber 51 that is coupled to the communication path 6 and that is provided with a diaphragm 55, which is a flexible thin film, and an urging portion 54 that urges the diaphragm 55 in a direction D in which a one-side end portion 54*a* expands the pressure chamber 51 with the spring pressure of a spring 56, which is an elastic body. Here, the other-side end portion of the urging portion 54 forms a valve 54*b*, and the valve 54*b* is urged in the direction D by the spring pressure of a spring 57, which is an elastic body, in a valve housing chamber 52. With such a configuration, a communication hole 60 between the pressure chamber 51 and the valve housing chamber 52 is self-sealed by the valve 54*b*.

In addition, the self-sealing valve 5 has, on the opposite side of the valve housing chamber 52 from the pressure chamber 51, a filter chamber 53, in which a filter 58 is formed, and the valve housing chamber 52 and the filter chamber 53 communicate with each other via the filter 58. Here, as illustrated in FIG. 2, in the supply device 3 of the present example, because the self-sealing valve 5 is not located between the tank 9 and the liquid ejecting head 2 and is provided on the opposite side of the liquid ejecting head 2 with respect to the tank 9, the inside of the communication path 6 and the self-sealing valve 5 contains only air. That is, ink does not enter the fluid entry path between the filter chamber 53 and the communication path 6, and only air enters. Then, a force is applied to draw air, which is a fluid, from the tank 9 side to the self-sealing valve 5 side through the communication path 6, and the inside of the tank 9 becomes negative pressure.

In the self-sealing valve 5 of the present example, the diaphragm 55 is urged by the urging portion 54 in the direction D in which the pressure chamber 51 expands. The self-sealing valve 5 is configured such that the pressure chamber 51 has a negative pressure. In addition, as described above, the urging portion 54 includes the valve 54*b*, so that when the pressure in the communication path 6 falls below a predetermined value, the urging portion 54 moves toward the opposite side of the direction D, the valve 54*b* opens the communication hole 60, and the valve housing chamber 52 and the pressure chamber 51 communicate with each other. When the gas flows into the pressure chamber 51 from the valve housing chamber 52 and thus the pressure in the communication path 6 returns to a predetermined value, the valve 54*b* closes. A pressurizing bag may be provided or may not be provided, and the valve housing chamber 52 and the filter chamber 53 may be directly coupled without the filter 58 therebetween.

Since the self-sealing valve 5 of the present example has such a configuration, the inside of the liquid ejecting head 2 can be brought to a suitable pressure by setting the inside of the tank 9 to a suitable pressure. However, as long as there is a simple configuration including the communication path 6 that communicates with the tank 9, the pressure chamber 51 provided with the diaphragm 55 and coupled to the communication path 6, and the urging portion 54 that urges the diaphragm 55 in the direction D in which the pressure chamber 51 expands, a pressure-adjusting portion having a different structure from the self-sealing valve 5 of the above-described structures may be provided.

Here, to summarize, the supply device 3 of the present example supplies ink to the liquid ejecting head 2, and includes the tank 9 that houses the ink, the liquid flow path 10 coupled to the tank 9 and the liquid ejecting head 2, and the self-sealing valve 5 as a pressure-adjusting portion that adjusts the pressure in the tank 9. The tank 9 is provided between the self-sealing valve 5 and the liquid flow path 10. In addition, the self-sealing valve 5 includes the communication path 6 that communicates with the tank 9, the pressure chamber 51 provided with the diaphragm 55 and coupled to the communication path 6, and the urging portion 54 that urges the diaphragm 55 in the direction in which the pressure chamber 51 expands.

As described above, because the supply device 3 according to the present example, as a pressure-adjusting portion that adjusts the pressure in the tank 9, has a simple configuration including the self-sealing valve 5 having the communication path 6, the pressure chamber 51, and the urging portion 54, a desired negative pressure can be applied to the ink of the liquid ejecting head 2 with a simple configuration. In addition, because the supply device 3 of the present example is configured such that the pressure-adjusting portion is provided in a location different from the liquid flow path 10 coupling the tank 9 and the liquid ejecting head 2 to each other, contact between the self-sealing valve 5 and the ink can be suppressed, and deterioration of the durability is suppressed. Furthermore, because contact between the self-sealing valve 5 and the ink can be suppressed, the self-sealing valve 5 can be easily replaced. Further, when a pump is used as the pressure-adjusting portion, not only does the cost increase, but also pulsation or the like occurs, therefore, by using the self-sealing valve 5 as described above as the pressure-adjusting portion, it is possible to suppress a decrease in liquid ejection accuracy due to ink pulsation. Furthermore, the type of ink that can be used is less limited by the material of the self-sealing valve 5, and the range of usable ink can be expanded.

Described from the viewpoint of the liquid ejecting apparatus 1, the liquid ejecting apparatus 1 according to the present example includes the supply device 3 having such a configuration, and ejects ink from the liquid ejecting head 2 to the medium P to form an image. As a result, the liquid ejecting apparatus 1 according to the present example uses the supply device 3 configured to apply a desired negative pressure to the ink of the liquid ejecting head 2 with a simple configuration and excellent durability, and forms an image on the medium P.

In addition, as described above, the liquid ejecting apparatus 1 according to the present example includes the carriage 4 including the liquid ejecting head 2 and the movement mechanism 20 that reciprocates the carriage 4 in the width direction B with respect to the medium P, and the tank 9 is provided in the carriage 4. With such a configuration, in the liquid ejecting apparatus 1 having the movement mechanism 20 that reciprocates the carriage 4, it is possible to shorten the liquid flow path 10 coupled to the tank 9 and the liquid ejecting head 2. Further, by shortening the liquid flow path 10, it is possible to suppress the outflow of impurities from the liquid flow path 10 to the ink, and it is possible to reduce ink waste by reducing the amount of ink in the liquid flow path 10.

Figure 4:
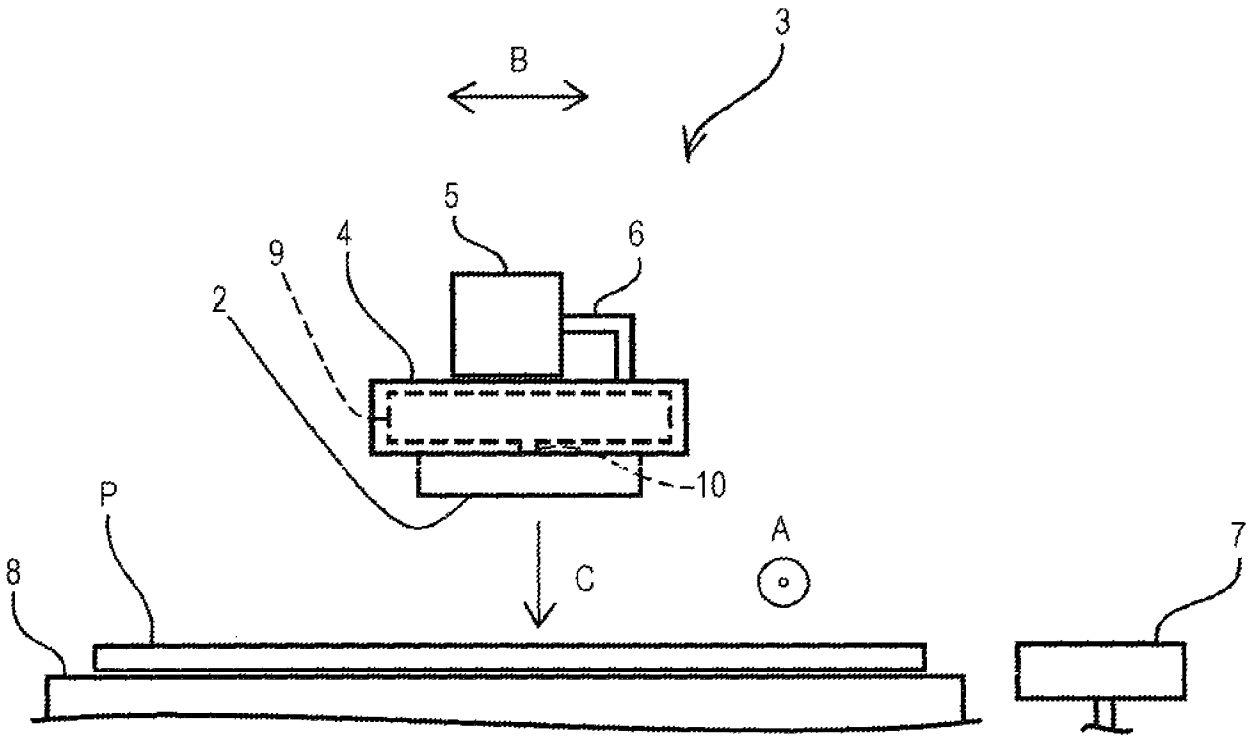
FIG. 4 is a schematic diagram of a supply device of a liquid ejecting apparatus according to Example 2 of the present disclosure.

Example 2 (FIG. 4)

Next, the liquid ejecting apparatus 1 according to Example 2 will be described with reference to FIG. 4. FIG. 4 is a schematic diagram of the supply device 3 of the liquid ejecting apparatus 1 of the present example, and corresponds to FIG. 2 illustrating the liquid ejecting apparatus 1 of Example 1. Here, because the configuration of the liquid ejecting apparatus 1 of the present example is the same as that of the liquid ejecting apparatus 1 of Example 1 except for the supply device 3, the description of portions having the same configuration is omitted. Further, the structural members that are common to Example 1 are illustrated with the same reference signs, and detailed description thereof is omitted.

As described above, in the supply device 3 in the liquid ejecting apparatus 1 of Example 1, the self-sealing valve 5 is formed at a position different from the carriage 4. On the other hand, in the supply device 3 of the present example, as illustrated in FIG. 4, the self-sealing valve 5 is provided on the carriage 4, that is, the carriage 4 includes the pressure-adjusting portion. Thus, in the supply device 3 of the present example, because the carriage 4 includes not only the tank 9 but also the self-sealing valve 5, the apparatus is particularly simplified, and the distance between the tank 9 and the self-sealing valve 5 is shortened to consequently increase the pressure adjustment accuracy in the tank 9 and thus the pressure adjustment accuracy in the liquid ejecting head 2. One reason is that pressure loss can be reduced by reducing the distance between the tank 9 and the self-sealing valve 5. In addition, when the self-sealing valve 5 is formed at a position different from the carriage 4, the communication path 6 is deformed as the carriage 4 moves and an error occurs between the pressure in the pressure chamber 51 in the self-sealing valve 5 and the pressure in the communication path 6. In the present example, however, the carriage 4 includes the self-sealing valve 5 to suppress such an error.

Further, although the supply device 3 of the present example has the self-sealing valve 5 and the tank 9 coupled by the communication path 6, which is flexible and tubular, it is not limited to such a configuration. For example, the self-sealing valve 5 and the tank 9 may be brought into close contact with each other, and a hole that couples the self-sealing valve 5 and the tank 9 may be used as the communication path 6.

Figure 5:
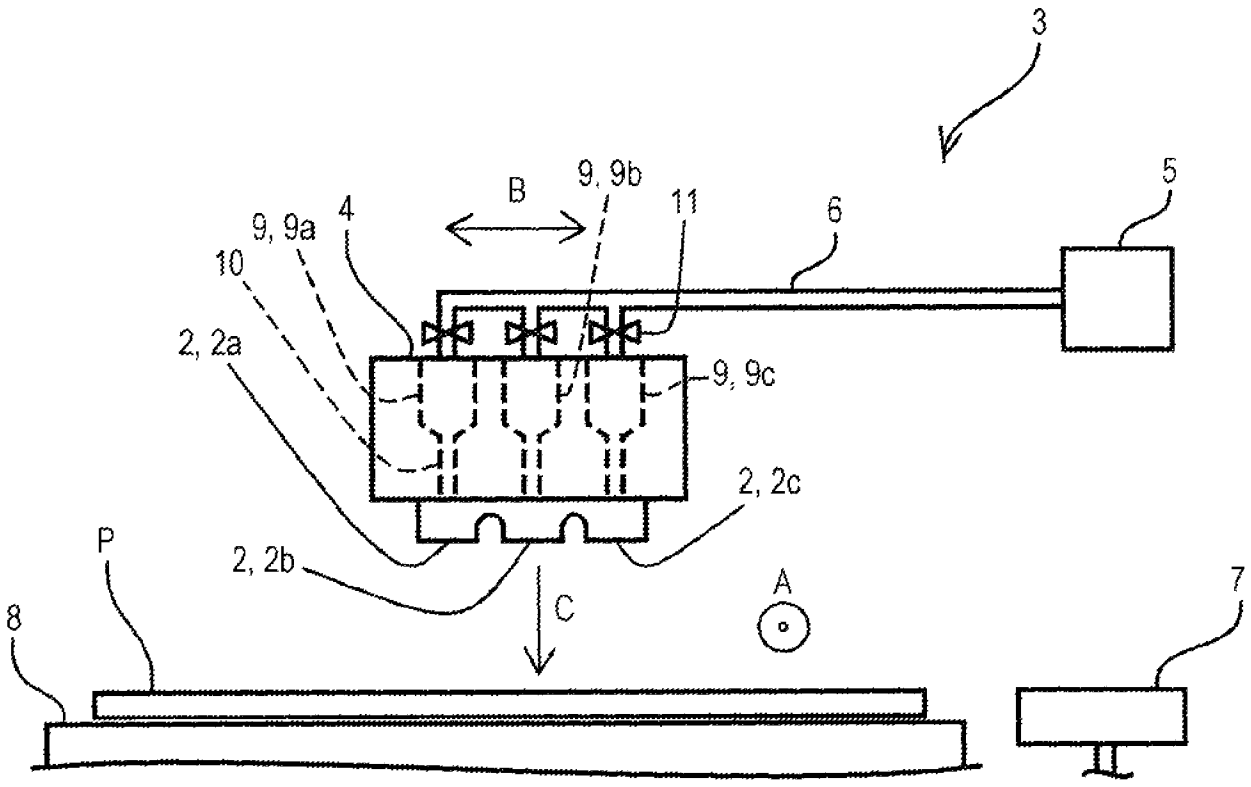
FIG. 5 is a schematic view of a supply device of a liquid ejecting apparatus according to Example 3 of the present disclosure.

Example 3 (FIG. 5)

Next, the liquid ejecting apparatus 1 of Example 3 will be described with reference to FIG. 5. FIG. 5 is a schematic diagram of the supply device 3 of the liquid ejecting apparatus 1 of the present example, and corresponds to FIG. 2 illustrating the liquid ejecting apparatus 1 of Example 1. Here, the configuration of the liquid ejecting apparatus 1 of the present example is the same as that of the liquid ejecting apparatus 1 of Example 1 and Example 2 except for the supply device 3, and thus the description of elements having the same configuration is omitted. Further, the structural members that are common to Example 1 and Example 2, are illustrated with the same reference signs, and detailed description thereof is omitted.

As described above, the supply device 3 in the liquid ejecting apparatus 1 according to Examples 1 and 2 is provided with one tank 9 in the carriage 4. On the other hand, in the supply device 3 of the present example, the carriage 4 includes a plurality of the tanks 9 as illustrated in FIG. 5. When the carriage 4 includes a plurality of the tanks 9 as in the supply device 3 of the present example, by housing different inks in a plurality of tanks 9*a*, 9*b* and 9*c*, different inks can be simultaneously ejected from corresponding liquid ejecting heads 2*a*, 2*b* and 2*c*. In addition, when the same ink is housed in the plurality of tanks 9*a*, 9*b*, and 9*c*, the same ink can be efficiently introduced into the liquid ejecting head 2, and ink can be ejected in a plurality of different ejection amounts depending on the image formation mode and the like.

In addition, in the supply device 3 in the liquid ejecting apparatus 1 of Example 1 and Example 2, the self-sealing valve 5 and the tank 9 are coupled on a one-to-one basis. On the other hand, in the supply device 3 of the present example, a plurality of the tanks 9 communicate with one self-sealing valve 5. As a result, the supply device 3 of the present example is simplified in a configuration including a plurality of the tanks 9.

In addition, the supply device 3 of the present example includes three opening/closing portions 11 that open and close the communication path 6 corresponding to the plurality of tanks 9*a*, 9*b*, and 9*c*. When different inks are stored in the plurality of tanks 9*a*, 9*b*, and 9*c*, there is a possibility that the volatile components of respective inks become mixed in the communication path 6 and that the volatile components of other inks may enter the tanks 9*a*, 9*b*, and 9*c*. Therefore, there are provided the opening/closing portions 11 that open and close the communication path 6, and in occasions other than when the pressure in the liquid ejecting head 2 needs to be adjusted during image formation or the like, the opening/closing portions 11 are closed and mixing of the volatile components of the ink in the communication path 6 is suppressed, thereby suppressing a change in the ink composition contained in the tanks 9*a*, 9*b* and 9*c*.

Figure 6:
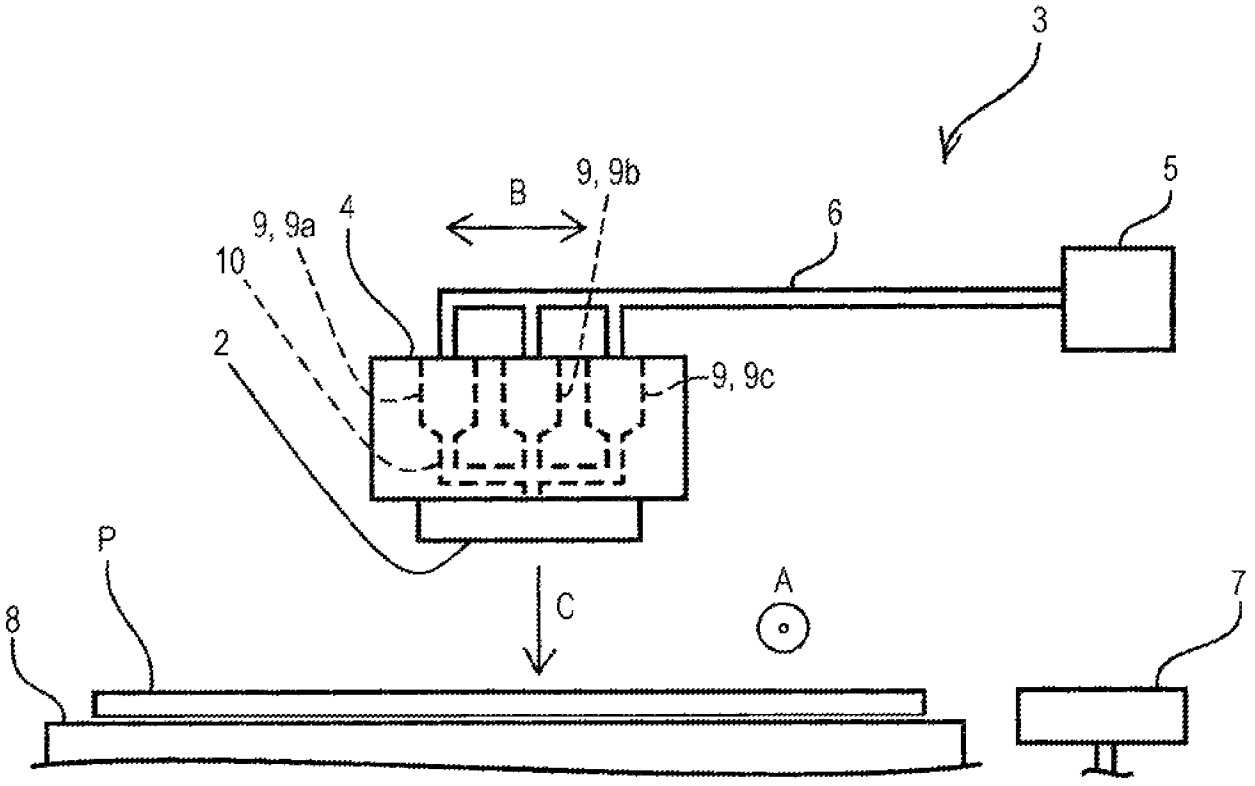
FIG. 6 is a schematic view of a supply device of a liquid ejecting apparatus according to Example 4 of the present disclosure.

Example 4 (FIG. 6)

Next, the liquid ejecting apparatus 1 of Example 4 will be described with reference to FIG. 6. FIG. 6 is a schematic diagram of the supply device 3 in the liquid ejecting apparatus 1 of the present example, and corresponds to FIG. 2 illustrating the liquid ejecting apparatus 1 of Example 1. Here, the configuration of the liquid ejecting apparatus 1 of the present example is the same as that of the liquid ejecting apparatus 1 of Examples 1 to 3 except for the supply device 3, and thus description of elements having the same configuration is omitted. Further, structural members that are common to the Examples 1 to 3 are illustrated with the same reference signs, and detailed description thereof is omitted.

As illustrated in FIG. 5, in the supply device 3 of the liquid ejecting apparatus 1 of Example 3, the liquid flow paths 10 are individually provided corresponding to the plurality of tanks 9*a*, 9*b*, and 9*c*. On the other hand, in the supply device 3 of the present example, as illustrated in FIG. 6, the liquid flow paths 10 formed from the plurality of tanks 9*a*, 9*b*, and 9*c* to the liquid ejecting head 2 are configured so as to merge midway. With this configuration, the supply device 3 according to the present example stores the same ink in the plurality of tanks 9*a*, 9*b*, and 9*c*, and ink can be ejected in a plurality of different ejection amounts depending on the image formation mode or the like.

Further, the liquid flow paths 10 of the present example are configured to merge before ink is supplied to the liquid ejecting head 2. However, the present disclosure is not limited to such a configuration. A configuration may be adopted in which ink is supplied to the liquid ejecting head 2 and then merged in an ink flow path in the liquid ejecting head 2.

Figure 7:
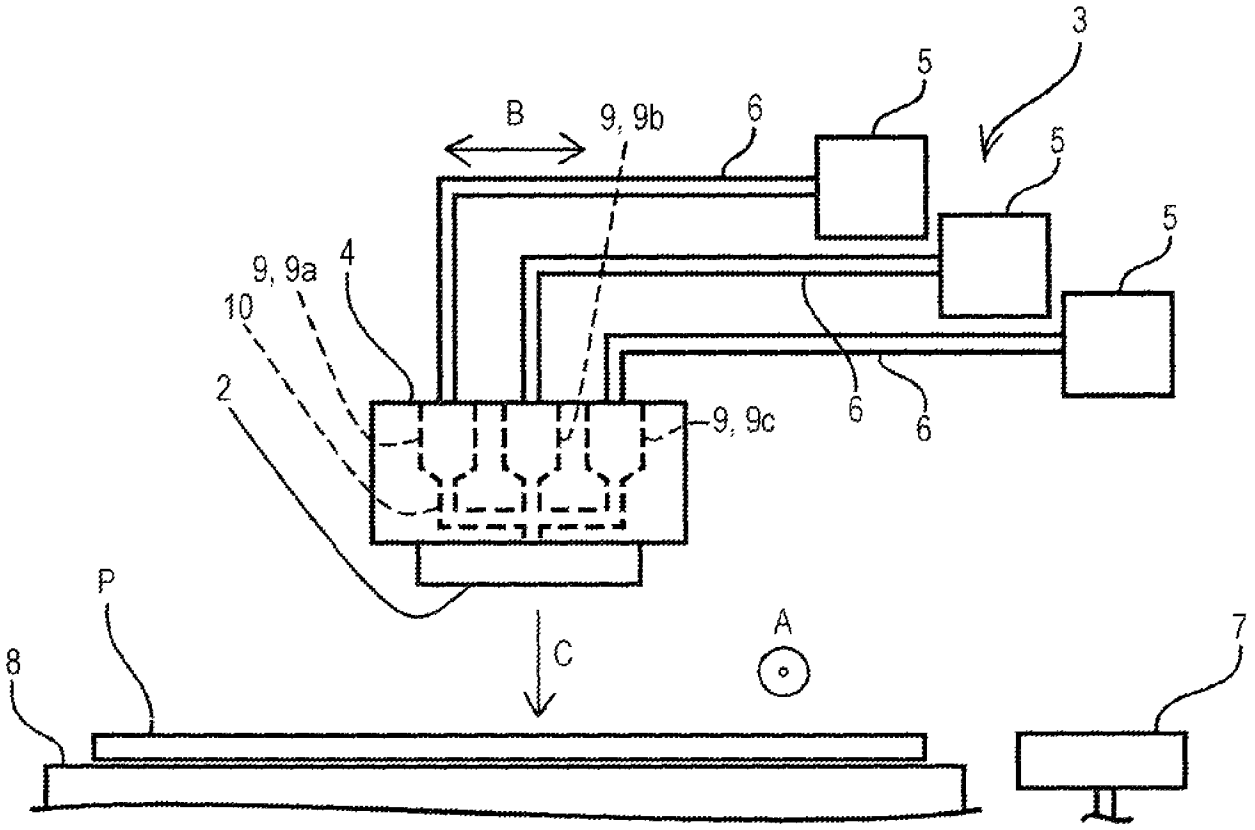
FIG. 7 is a schematic view of a supply device of a liquid ejecting apparatus according to Example 5 of the present disclosure.

Example 5 (FIG. 7)

Next, the liquid ejecting apparatus 1 of Example 5 will be described with reference to FIG. 7. FIG. 7 is a schematic diagram of the supply device 3 in the liquid ejecting apparatus 1 of the present example, and corresponds to FIG. 2 illustrating the liquid ejecting apparatus 1 of Example 1. Here, the configuration of the liquid ejecting apparatus 1 of the present example is the same as that of the liquid ejecting apparatus 1 of Examples 1 to 4 except for the supply device 3, and thus description of elements having the same configuration is omitted. Further, structural members that are common to Examples 1 to 4 are illustrated with the same reference signs, and detailed description thereof is omitted.

As illustrated in FIGS. 5 and 6, in the supply device 3 of the liquid ejecting apparatus 1 of Examples 3 and 4, one self-sealing valve 5 was provided so as to correspond to the plurality of tanks 9*a*, 9*b* and 9*c*. On the other hand, as illustrated in FIG. 7, in the supply device 3 of the present example, the self-sealing valves 5 are individually provided so as to correspond to the plurality of tanks 9*a*, 9*b*, and 9*c*.

Further, the disclosure is not limited to the above described examples, and it goes without saying that it is possible to make various modifications within the scope of the disclosure described in the claims and that these are included in the scope of the disclosure.

What is claimed is:

1. A supply device that supplies a liquid to a liquid ejecting head, the supply device comprising:

one or more tanks that house the liquid;

a liquid flow path coupled to the one or more tanks and the liquid ejecting head; and a pressure-adjusting portion that adjusts a pressure in the one or more tanks, the pressure-adjusting portion being a self-sealing valve, wherein the one or more tanks are provided between the pressure-adjusting portion and the liquid flow path, the pressure-adjusting portion includes a communication path that communicates with the one or more tanks, a pressure chamber provided with a diaphragm and coupled to the communication path, and an urging portion that urges the diaphragm in a direction in which the pressure chamber expands, and the inside of the communication path and the self-sealing valve contains only air when pressure is adjusted such that no liquid enters the communication path or the self-sealing valve.

2. A liquid ejecting apparatus comprising:

the supply device according to claim 1, wherein the liquid ejecting head ejects the liquid onto a medium to form an image.

3. The liquid ejecting apparatus according to claim 2, further comprising:

a carriage provided with the liquid ejecting head; and a movement mechanism for reciprocating the carriage with respect to the medium, wherein the carriage is provided with the one or more tanks.

4. The liquid ejecting apparatus according to claim 3, wherein the carriage is provided with a plurality of the tanks.

5. The liquid ejecting apparatus according to claim 4, wherein the plurality of the tanks communicate with the pressure-adjusting portion.

6. The liquid ejecting apparatus according to claim 3, wherein the carriage is provided with the pressure-adjusting portion.

* * * * *